US006752383B2

(12) United States Patent
Collins

(10) Patent No.: US 6,752,383 B2
(45) Date of Patent: Jun. 22, 2004

(54) DEVICE FOR LIFTING PARTITIONS

(76) Inventor: Harvey C. Collins, 26320 Harbour Pointe Dr., Harrison Township, MI (US) 48045

( * ) Notice: Subject to any disclaimer, the term of this patent is extended or adjusted under 35 U.S.C. 154(b) by 59 days.

(21) Appl. No.: 10/287,102

(22) Filed: Nov. 4, 2002

(65) Prior Publication Data

US 2004/0084662 A1 May 6, 2004

(51) Int. Cl.[7] ..... B66F 3/00
(52) U.S. Cl. ..... 254/133 R; 254/8 B
(58) Field of Search ..... 254/133 R, 134, 254/129, 131, DIG. 4, 8 B, DIG. 1, 1, 2 R, 2 B

(56) References Cited

U.S. PATENT DOCUMENTS 4,750,712 A * 6/1988 Genovese ..... 254/124
4,804,068 A * 2/1989 Carter ..... 254/91
4,848,732 A * 7/1989 Rossato ..... 254/133 R
5,181,694 A * 1/1993 Collins ..... 254/133 R
5,199,686 A * 4/1993 Fletcher ..... 254/10 R
5,299,779 A 4/1994 Collins

* cited by examiner

*Primary Examiner*—Robert C. Watson
(74) *Attorney, Agent, or Firm*—Gifford, Krass, Groh, Sprinkle, Anderson & Citkowski, P.C.

(57) ABSTRACT

A device for lifting office partitions having a housing with a main body portion and spaced apart base legs. The main body portion is spaced upwardly from the base legs at one end of the housing to form an open channel between the main body portion and the base legs. An elongated lever has one end pivotally mounted about a first axis to the housing. A piston and cylinder assembly is movable between a retracted and extended position. One end of the piston and cylinder assembly is secured to the housing while the second end is pivotally secured to the lever about a second axis parallel to but spaced radially from the first axis. A lift bracket is attached to the other end of the lever so that the lift bracket vertically moves in synchronism with the extension and retraction of the piston and cylinder assembly. A torsion bar assembly is disposed between the main body portion of the housing and the base legs adjacent the lift bracket. Threaded fasteners are threadably mounted to the torsion bar so that, upon tightening of the threaded fasteners, an outward torsion is exerted between the base legs and the main housing portion.

12 Claims, 4 Drawing Sheets

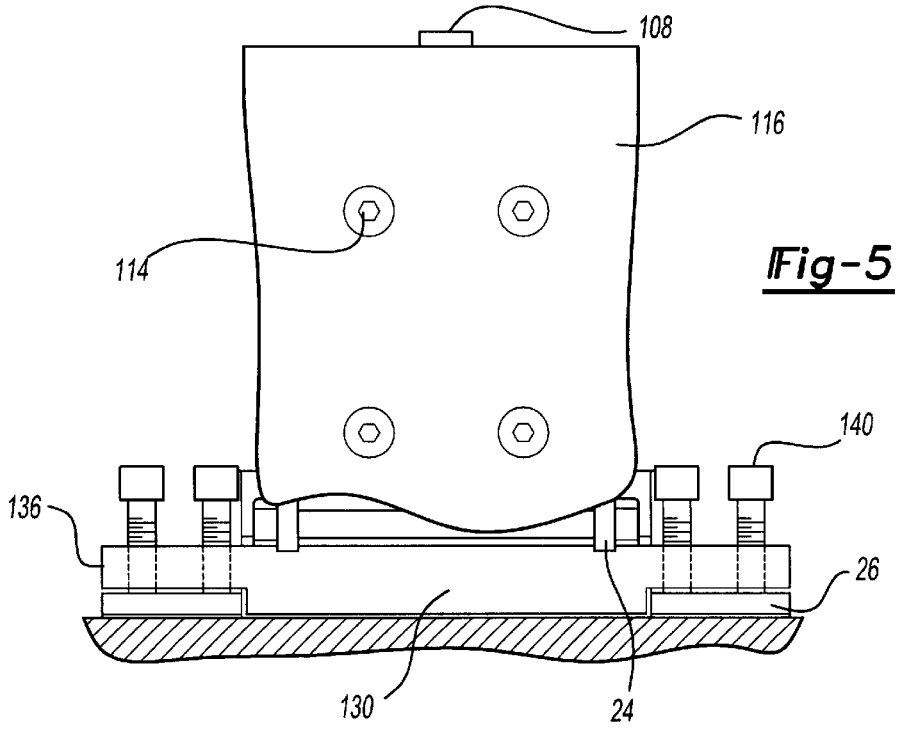
Fig-5
Fig-6
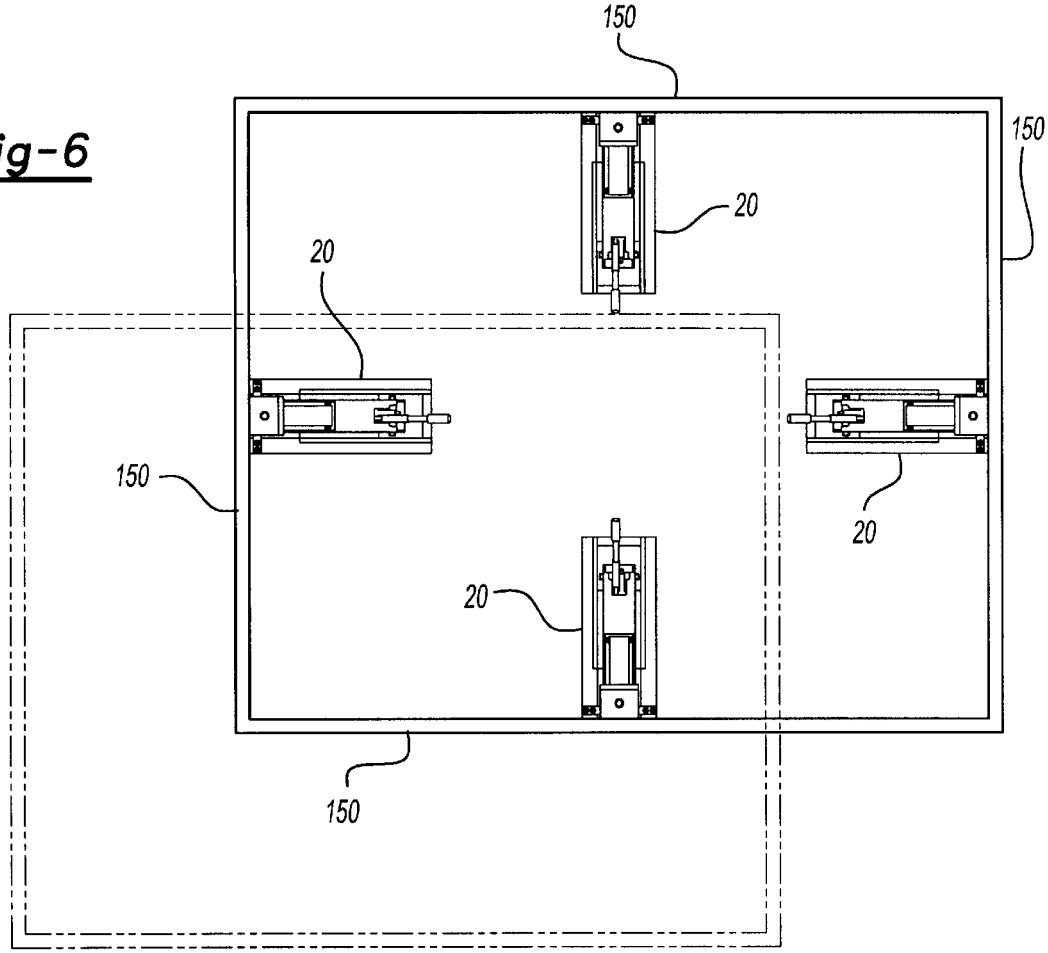

DEVICE FOR LIFTING PARTITIONS

BACKGROUND OF THE INVENTION

I. Field of the Invention

The present invention relates generally to lifting devices and, more particularly, to a device for lifting office partitions.

II. Description of the Prior Art

Many office buildings include modular partitions which define the workspaces for the employees working in the building. These modular partitions, however, present special difficulties during the installation of flooring, such as carpet, ceramic tile or the like.

When flooring is to be installed in an office building having modular partitions, it has been the previously known practice to disassemble the office partitions, install the flooring, and then reassemble the office partitions. This procedure, while effective in operation, is disadvantageously very time consuming and thus very expensive in labor costs. Furthermore, any error during the reassembly of the office partition can and oftentimes will create additional difficulties for the employee.

In order to eliminate the necessity of disassembling the office partitions prior to the installation of the flooring and the subsequent reassembly of the office partitions following the flooring installation, there have been previously known lifts designed to slightly elevate the partition without disassembling the partition. Furthermore, only a slight elevation of the office partition, e.g. a quarter of an inch, is necessary to permit the installation of the flooring. Examples of these previously known partition lifts are shown in U.S. Pat. No. 5,299,779, issuing Apr. 5, 1994, as well as U.S. Pat. No. 4,846,443, which issued on Jul. 11, 1989.

These previously known partition lifts included a housing having a lever pivotally mounted at one end to a midpoint of the housing. A lift bracket designed to extend under the office partition was then attached to the other end of the lever.

In order to pivot the lever about its pivotal point, and thus vertically displace the lifting bracket, a piston and cylinder assembly had one end secured to the housing and a second end pivotally secured to the lever about an axis parallel to, but spaced radially from, the pivotal connection of the lever with the housing. Consequently, extension and retraction of the piston and cylinder arrangement simultaneously articulated the lever which, in turn, vertically displaced the left bracket and office partitions in the desired fashion.

There have, however, been a few disadvantages with these previously known partition lifts. A primary disadvantage of these previously known partition lifts is that, when the partition lift is used to raise a very heavy office partition, the end of the housing most spaced from the lift bracket lifts up from the ground due to the torsional force exerted on the housing by the weight of the partition. Such lifting of the housing not only renders the partition lift more difficult to use, but can even cause a dangerous situation in the event that the lift bracket abruptly disengages from the office partition. Such disengagement of the bracket from the office partition can also cause damage to the partition lift.

SUMMARY OF THE PRESENT INVENTION

The present invention provides a partition lift which overcomes all of the above-mentioned disadvantages of the previously known devices.

In brief, the partition lift of the present invention comprises a housing having a main body portion and spaced apart base legs on opposite sides of the main body portion. The base legs are adapted to be supported by a ground surface. Furthermore, the main body portion is spaced upwardly from the base legs at one end of the housing to form an open channel between the main body portion and the base legs at one end of the housing.

An elongated lever is then pivotally mounted at one end of the lever to a midpoint of the housing. This lever is pivotal about a first pivot axis.

A piston and cylinder assembly has one end secured to the other end of the housing and the other end of the piston and cylinder assembly pivotally attached about a second pivot axis to the lever. The second pivot axis is parallel to but radially spaced from the first pivot axis between the lever and the housing. Consequently, extension and retraction of the piston and cylinder assembly vertically displaces the other end of the lever relative to the housing.

A lift bracket assembly is attached to the end of the lever most spaced from the first pivot axis. This lift bracket assembly may take any of several forms necessary such that a portion of the bracket assembly extends underneath the partition to be lifted. In one embodiment, a plate is attached to the other end of the lever. One or more hangers are then adjustably mounted to the plate such that a tab portion of the hanger extends underneath the partition to be lifted. The horizontal adjustability of the hangers relative to the plate enables the hangers to be properly positioned to avoid damage to the partition and/or achieve the most sufficient lift of the partition in operation.

A torsion bar assembly is then disposed in the channel between the housing main portion and the spaced apart base legs. This torsion bar assembly includes an elongated rigid bar having an upper surface in abutment with the bottom of the housing main portion. At least two, and preferably four, threaded fasteners are then threadably mounted on opposite ends of the torsion bar. These fasteners, furthermore, abut against an upper surface of the base legs. Thus, upon tightening of the threaded fasteners, the torsion bar assembly creates an outward force between the base legs and the main housing portion in a generally vertical direction.

The torsion bar assembly thus preloads the tension between the base legs and the housing main portion. When lifting a heavy partition, the torsion bar, by preloading the tension between the base legs and the housing main portion, ensures that the base legs remain flatly in contact with the ground support surface during the entire lifting operation.

The partition lift of the present invention enjoys further design enhancements over the previously known partition lifts. For example, a handle is secured to the main housing portion about a midpoint for easy transport of the partition lift. Similarly, non-friction pads can be applied to the bottom of the base legs so that, by using multiple lifts on a single partition, upon elevation of the partition by the lifts, the lifts together with the partition may be horizontally slid along the ground support surface.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 5 is a front fragmentary view of the preferred embodiment of the present invention;

FIG. 6 is a top diagrammatic view illustrating the use of the lift of the present invention to move partitions;

DETAILED DESCRIPTION OF A PREFERRED EMBODIMENT OF THE PRESENT INVENTION

Figure 1:
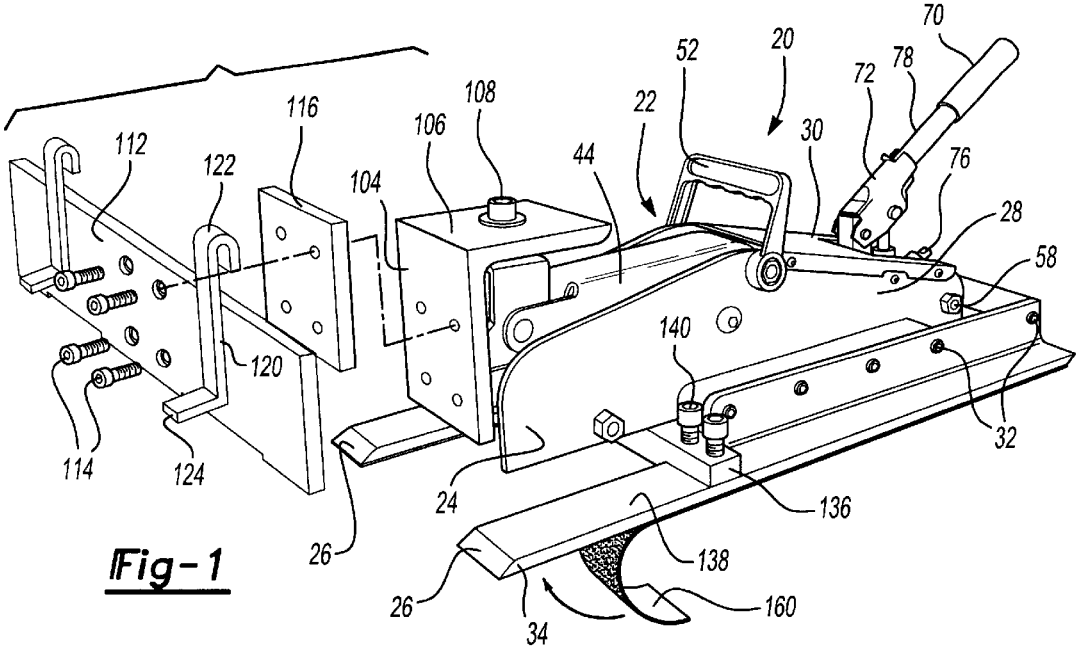
FIG. 1 is an elevational view illustrating a preferred embodiment of the present invention.

With reference first to FIG. 1, a preferred embodiment of the partition lift 20 of the present invention is shown. The partition lift 20 includes a housing 22 having a main housing portion 24 and a pair of spaced apart base legs 26. The.main housing portion 24 includes a pair of spaced apart sidewalls 28 (only one shown in FIG. 1) and a top plate 30. One base leg 26 is secured to each sidewall 28 by appropriate fasteners 32. The base legs 26 each have a lower surface 34 adapted to be supported by a ground surface 36. Additionally, a reinforcing bolt 37 extending between and secured to the sidewall 28 rigidities the housing 22. Furthermore, the entire housing 22, i.e. the main housing portion 24 as well as the base legs 26, are preferably constructed of aluminum for high strength and yet reasonably low weight.

Figure 2:
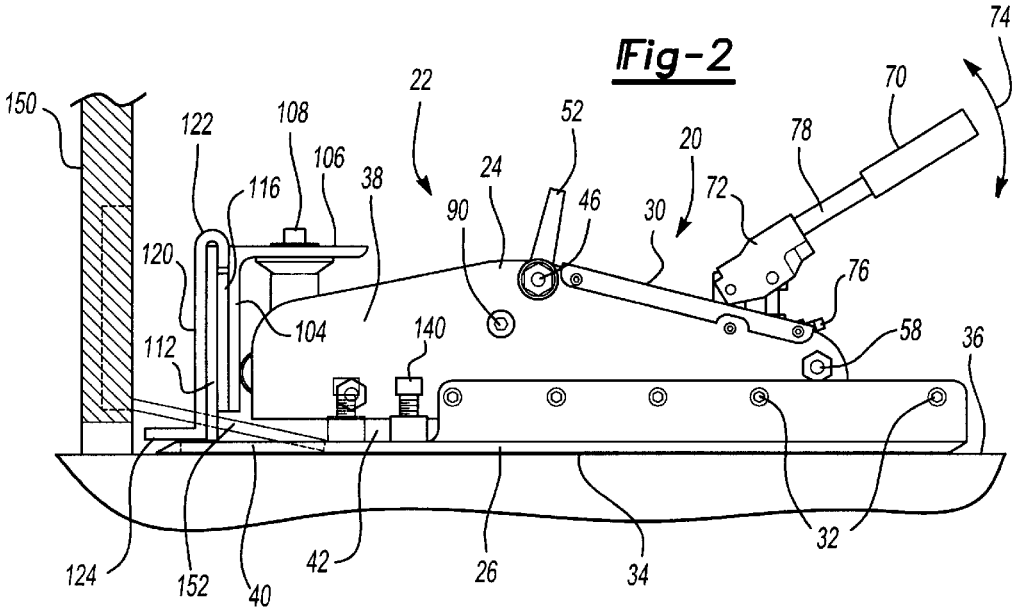
FIG. 2 is a side view illustrating the preferred embodiment of the present invention.

With reference now particularly to FIG. 2, one end 38 of the main housing portion 24 is spaced upwardly from an upper surface 40 of the base leg 26 thus forming an open channel 42 in between the main housing portion 24 and the base legs 26. The purpose of the open channel 42 will be subsequently. described in greater detail.

Figure 8:
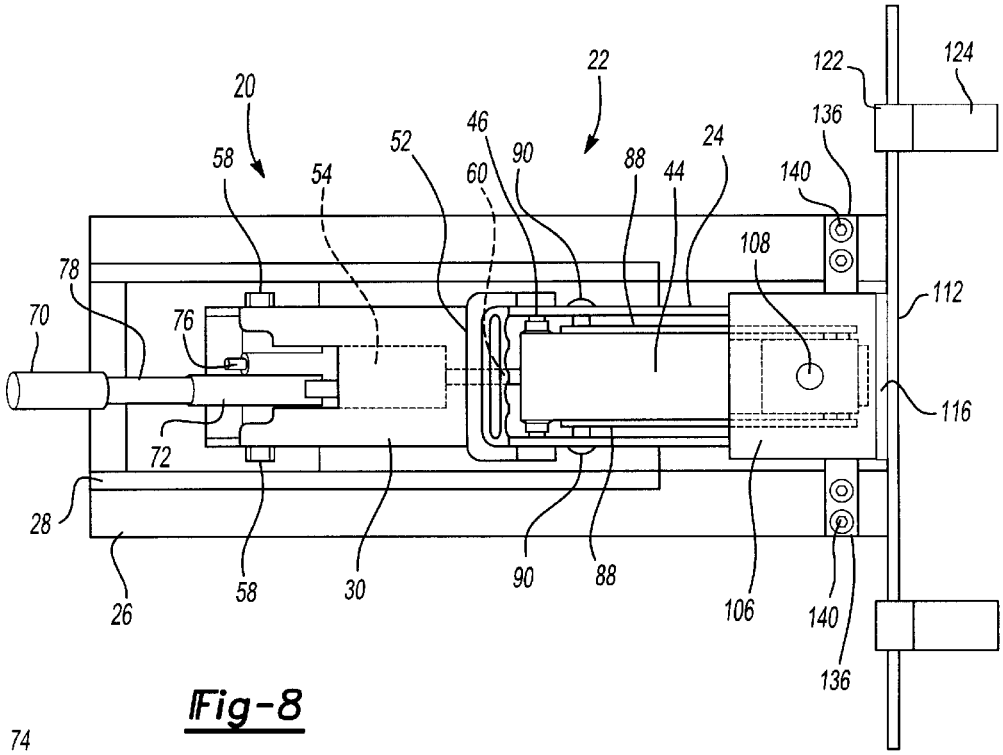
FIG. 8 is a top plan view of the preferred embodiment of the present invention.
Figure 7:
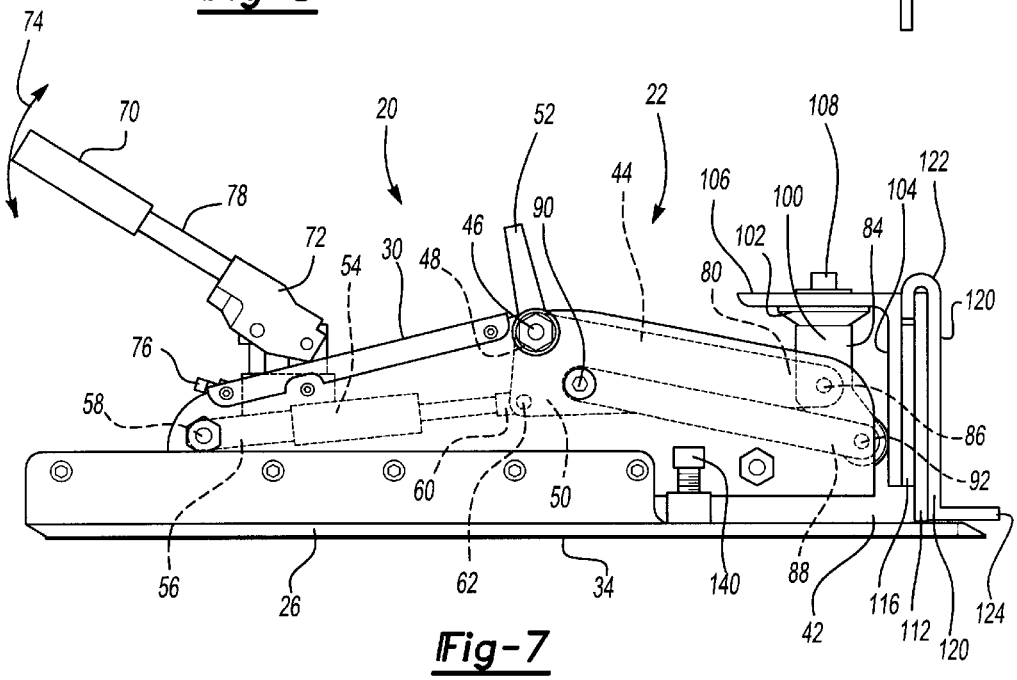
FIG. 7 is a side view illustrating the operation of the present invention.

With reference now particularly to FIGS. 7 and 8, an elongated lever 44 has one end pivotally mounted about a pivot axis 46 to the main housing portion 24. Preferably, a bolt 48 extends through the end 50 of the lever and this bolt 48 is secured at both ends to the sidewalls 28 of the main housing portion 24. Preferably, a handle 52 is secured to the ends of the bolt 50 in order to facilitate transportation of the lift 20.

As best shown in FIGS. 7 and 8, a piston and cylinder assembly 54 having a pump actuator 72 is movable between an extended and a retracted position. One end 56 of the piston and cylinder arrangement 54 is connected to the housing sidewalls 28 by a bolt 58. The opposite end 60 of the piston and cylinder arrangement is pivotally secured to the lever 44 about a pivot axis 62 which is parallel to but radially spaced from the pivot axis 46 between the lever 44 and housing sidewalls 28. Preferably, the piston and cylinder assembly 54 is a hydraulic piston and cylinder assembly.

With reference now to FIGS. 2 and 7, a handle 70 is detachably secured to the actuator. Consequently, reciprocation of the handle 70 as indicated by arrow 74 in FIG. 2 moves the piston and cylinder arrangement 54 towards its extended position. The opening of a relief valve 76 on the actuator 72 allows the piston and cylinder arrangement 54 to move to its retracted position. Preferably, an end 78 (FIG. 2) of the handle 70 is formed as a wrench to open and close the relief valve 76 when the handle 70 is removed from the actuator 72.

Figure 3:
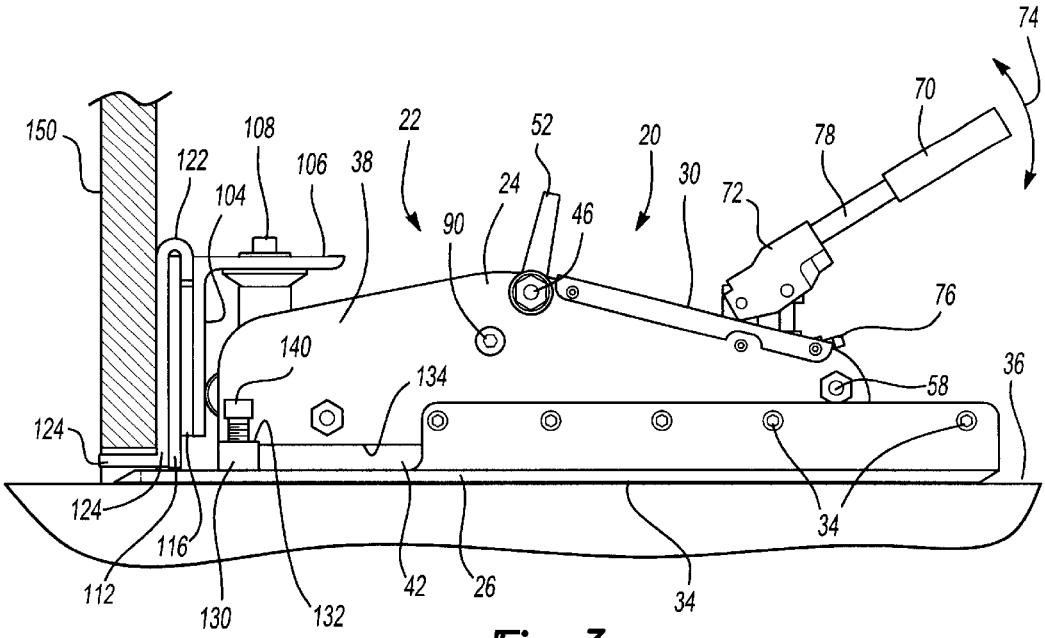
FIG. 3 is a side view, similar to FIG. 2, illustrating the preferred embodiment of the present invention.
Figure 4:
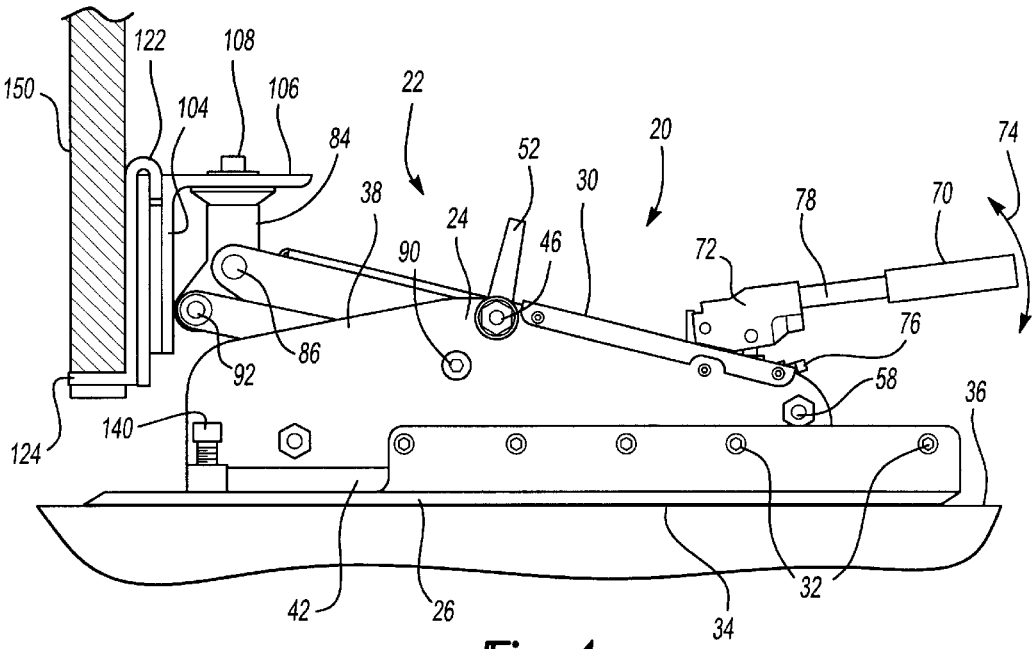
FIG. 4 is a view similar to FIG. 3 but illustrating the lift in an elevated position.

With reference now particularly to FIGS. 3 and 4, the extension of the piston and cylinder arrangement 54 vertically elevates the end 80 of the lever 44 from the position shown in FIG. 4 and to the position shown in FIG. 3 in synchronism with the extension and retraction of the piston and cylinder arrangement 54.

As best shown in FIG. 7, a lift bracket assembly 84 is pivotally secured to the end 80 of the lever 44 by a pivot pin 86. Furthermore, as best shown in FIGS. 7 and 8, in order to maintain the vertical alignment of the lift bracket assembly 84 as it is vertically displaced during pivotal action of the lever 44, at least one, and preferably two spaced apart elongated bars 88 each have one end pivotally mounted to the housing sidewalls 28 by a pivot pin 90 and their other end pivotally secured to the lift bracket assembly 84 by a further pivot pin 92. The elongated bars 88 and the pivotal connection with the bracket assembly 84 and housing sidewalls 28 effectively form a parallelogram with the lever 44 and its pivotal connection with the housing sidewalls 28 and bracket assembly 84. As such, the vertical alignment of the bracket assembly 84 is maintained during vertical movement of the left bracket assembly 84.

With reference now to FIGS. 1, 7 and 8, the bracket assembly 84 comprises a main body 100 which is pivotally secured to the lever 44 and bars 88 as previously described. This main body 100 includes an upper planar surface 102. One leg 106 of an L-shaped bracket 104 is then secured to the upper surface 102 of the main body 100 by an appropriate fastener 108. In doing so, the second leg 110 of the L-shaped bracket 104 lies in a generally vertical plane and includes a plurality of threaded bores.

As best shown in FIGS. 1 and 2, an elongated plate 112 is then threadably secured by fasteners 114 to the front of the leg 110 of the L-shaped bracket 104. Optionally, a spacer plate 116 is disposed in between the plate 112 and the L-shaped bracket 104. Although the plate 112 is illustrated as planar in shape, alternatively the plate 112 may have two perpendicular sections and used in a corner.

At least one, and more typically several, hangers 120 each have a hook 122 at their upper end which is disposed over the upper edge of the plate 112. These hooks 122, furthermore, may be adjustably positioned along the plate 112 by simply sliding the hangers 120 along the plate 112. The spacer plate 116 also spaces the plate 112 outwardly from the L-shaped bracket 104 by a distance sufficient to create a space for the hook 122.

The other or lower end of the hangers 120 each includes an outwardly extending tab 124 which is adapted to be positioned under the office partition 150 (FIG. 2) to be lifted. In practice, the tabs 124 are positioned under solid portions of the office partition 150 so that, during the lifting operation, the office partition 150 is undamaged.

With reference now to FIGS. 1, 2, 3 and 5, an elongated torsion bar 130 is positioned within the open channel 42 between the main housing portion 24 and the base legs 26. This torsion bar 130 is dimensioned so that an upper surface 132 of the torsion bar 130 abuts against a bottom surface 134 of the housing sidewalls 28 and so that each end 136 (FIG. 5) of the torsion bar 130 overlies a top surface 138 of the base legs 26.

At least one, and preferably two threaded fasteners 140 threadably engage threaded bores in the ends 136 of the torsion bar 130. Upon tightening of these fasteners 140, an outwardly and vertically directed force is created by the torsion bar 130 and the fasteners 140 between the base legs 26 and the main housing portion 24. This outward force, furthermore, is maximized when the torsion bar 130 is positioned adjacent the front end of the main housing portion 24 as shown in FIG. 3 as opposed to positioning the torsion bar 130 at the base of the channel 142 as illustrated in FIG. 1.

By positioning the torsion bar 126 adjacent the front of the housing 24 and tightening the fasteners 140 as previously described, the torsion bar 130 effectively pretensions the main housing portion 24 relative to the base legs 26. Thus, when the lift of the present invention is utilized to lift very heavy office partitions, the torsion bar 130 effectively maintains the base legs 26 flatly on the ground support surface 36.

With reference now to FIG. 2, however, it is advantageous to allow the torsion bar 130 to be moved to the bottom of its channel 42 as shown in FIG. 2. In some cases, the office partition 150 includes an electrical channel cover 152. This electrical channel cover 152 is oftentimes movable from its operative position, shown in phantom line in FIG. 2, to an open position, as shown in solid line in FIG. 2 while still remaining attached to the office partition. In order to lift the partition 150, it is necessary to move the electrical channel cover 152 to its open position in which the channel cover 152 lies flatly on the ground support surface 136 but is still connected to the partition 150. In this event, the open channel 42 formed between the housing main portion 24 and the base legs 26 provides an appropriate channel for receiving the electrical cover 152 and still allowing operation of the partition lift 20.

Although the operation of the present invention should, by now, be apparent, with reference now to FIG. 4, in operation the lift 20 is positioned adjacent the partition 150 such that the tabs 124 of the hangers 120 are positioned under the bottom of the partition 150. The positions of the hangers 120 along their support plate 112 are adjusted so that the tabs 124 register with solid structural portions of the partition 150.

After the tabs 124 are positioned under the partition 150, the handle 70 is reciprocated as indicated by arrow 74 thus moving the piston and cylinder arrangement 54 toward its extended position. In doing so, the hangers 120 move in unison with the bracket assembly 84 thus elevating the office partition 150 from the position shown in phantom line and to the position shown in solid line.

With reference now to FIGS. 1 and 6, optionally a low friction pad 160 is applied to the bottom surface 34 of each base leg 26. Then, when multiple devices 20 are secured to the various walls of the office partition 150 as shown in FIG. 6, the office partition 150 may be elevated and then slid horizontally along the ground support surface from the position shown in solid line and to the position shown in phantom line.

From the foregoing, it can be seen that the present invention provides a new and improved partition lift which is particularly useful for installing new flooring in buildings having movable partitions. Having described my invention, however, many modifications thereto will become apparent to those skilled in the art to which it pertains without deviation from the spirit of the invention as defined by the scope of the appended claims.

I claim:

1. A device for lifting partitions comprising:

a housing having a main body portion and spaced apart base legs adapted to be supported by a ground surface, said main body portion being spaced upwardly from said base legs at one end of said housing to form an open channel between said main body portion and said base legs at said one end of said housing, an elongated lever pivotally mounted at a first end to said housing about a first pivot axis, a piston and cylinder assembly movable between a retracted and an extended position, one end of said piston and cylinder assembly being secured to said housing and a second end of said piston and cylinder assembly being pivotally secured to said lever about a second pivot axis parallel to and radially spaced from said first pivot axis, a lift bracket assembly attached to a second end of said lever at said one end of said housing, a torsion bar assembly disposed in said channel, said torsion bar assembly having a lower portion in abutment with an upper surface of both of said base legs and an upper portion in abutment with a lower surface of said housing main body portion, said torsion bar assembly including means for selectively exerting an outward force between base legs and said housing main body portion.

2. The invention as defined in claim 1 wherein said exerting means comprises at least one threaded member, said threaded member being threadably mounted in a threaded bore in said torsion bar and having one end in contact with at least one of said base legs.

3. The invention as defined in claim 2 and comprising at least two threaded members, one threaded member being threadably mounted to each end of said torsion bar.

4. The invention as defined in claim 1 wherein said lift bracket is pivotally mounted to said lever and comprising a first elongated bar, a first end of said first bar being pivotally secured to said housing about an axis parallel to and radially spaced from said first pivot axis, and a second end of said first bar being pivotally secured to said lift bracket.

5. The invention as defined in claim 4 and comprising a second elongated bar, said second elongated bar being spaced apart and parallel to said first elongated bar, said second elongated bar having first and second ends pivotally secured to said housing and said lift bracket coaxially with said first and second ends of said first elongated bar, respectively.

6. The invention as defined in claim 5 wherein said first and second elongated bars are disposed on opposite sides of said lever.

7. The invention as defined in claim 1 and comprising a handle secured to an upper portion of said housing.

8. The invention as defined in claim 7 and comprising a second handle secured to an end of said housing opposite from said lift bracket, said second handle being cylindrical in shape.

9. The invention as defined in claim 1 wherein said housing main portion includes two sidewalls disposed on opposite sides of said lever, and comprising an elongated reinforcing pin extending between and secured to said sidewalls.

10. The invention as defined in claim 1 and comprising a non-friction pad attached to a bottom surface of said base legs.

11. The invention as defined in claim 1 wherein said lift bracket assembly comprises an L-shaped bracket attached to said lever, a plate secured to the L-shaped bracket, and at least one hanger slidably mounted to said plate, each said hanger having a tab positionable under a partition.

12. The invention as defined in claim 1 wherein said piston and cylinder assembly comprises a hydraulic piston and cylinder assembly.

* * * * *